United States Patent [19]

Peterson

[11] Patent Number: 4,938,250

[45] Date of Patent: Jul. 3, 1990

[54] GATE VALVE WITH PARTICLE CLEARING ACTION

[75] Inventor: L. Neil Peterson, Salina, Kans.

[73] Assignee: Salina Vortex Corp., Salina, Kans.

[21] Appl. No.: 369,006

[22] Filed: Jun. 20, 1989

[51] Int. Cl.[5] ..... F16K 3/02; F16K 3/316; B08B 9/02

[52] U.S. Cl. ..... 137/244; 137/240; 251/328; 251/329

[58] Field of Search ..... 137/242, 244, 238, 240; 251/326, 327, 328, 329

[56] References Cited

U.S. PATENT DOCUMENTS

| | | | |
|---|---|---|---|
| 2,550,984 | 5/1951 | Ferguson | 137/244 |
| 2,669,416 | 2/1954 | Hilton | 251/329 |
| 2,982,295 | 5/1961 | Williams | 251/328 |
| 2,982,513 | 5/1961 | Krummel | 137/244 |
| 3,000,608 | 9/1961 | Williams | 251/328 |
| 3,945,606 | 3/1976 | McDonald | 251/329 |
| 4,201,365 | 5/1980 | Paptzun et al. | 251/328 |
| 4,221,307 | 9/1980 | Peterson | 251/328 |
| 4,257,447 | 3/1981 | Clarkson | 251/328 |
| 4,383,546 | 5/1983 | Walters, Jr. | 137/240 |
| 4,773,627 | 9/1988 | King et al. | 251/328 |

*Primary Examiner*—George L. Walton

*Attorney, Agent, or Firm*—Kokjer, Kircher, Bradley, Wharton, Bowman & Johnson

[57] ABSTRACT

A knife gate valve for regulating particular material flow in a pneumatic or vacuum covering system. An actuated, reciprocative gate is mounted within the valve housing on guide bars which define the path of gate movement between open and closed positions. The guide bars seal the side edges of the gate and the adjacent portion of the lower gate surface. A seal plate is loaded by a pair of o-rings to seal against the top gate surface. Transverse seals are accessible for cleaning or replacement through releasable side seal assemblies. Fluid ports allow the transverse seals to be lubricated in place or air purged. The guide bars are cleaned by the gate during closure with the opposed gate surfaces being cleaned by the seal plate and an underlying wiper bar during gate movement. The cleaning actions cooperate with dynamic loading of the various seals to assure a proper seal about the gate upon closure.

21 Claims, 3 Drawing Sheets

GATE VALVE WITH PARTICLE CLEARING ACTION

BACKGROUND AND SUMMARY OF THE INVENTION

This invention relates generally to the handling of dry bulk materials and more particularly to a knife gate valve which is specially constructed to clear particulate matter from the gate and sealing surfaces during open and closing movement of the gate.

The handling of various types of dry bulk materials frequently involves conveying of the material by means of a pneumatic or vacuum conveying system. Among the types of solid particulate materials that are handled in this fashion are powdered materials and granular materials such as foods, grain and plastics. The conveying system typically includes flow control devices that may be knife gate valves, butterfly valves or rotary air locks.

Although knife gate valves are widely used in this type of application, the knife gates that have been available in the past have not been wholly free of problems. Perhaps the most prevalent problem has been the tendency for particulate matter to become wedged inside of the valve, usually between the gate and its sealing surfaces. This can cause the gate to bind or otherwise operate unsatisfactorily, and it can also impair the sealing action and cause leakage of air or vacuum. The particulate matter can also build up on the gate or other internal surfaces and cause similar problems. Valves that are intended for controlling the flow of fluids are ineffective when they must be closed in the presence of a stream of particulate material flow. Another problem with prior valves has resulted from the use of soft rubber seals which are susceptible to erosion and other deterioration caused by the abrasive action of the particulate material.

Accordingly, a need remains for a gate valve which can be effectively closed and sealed in the presence of particulate flow and which is constructed to operate effectively for extended periods of service.

The present invention is directed to a gate valve which provides a positive seal across the valve opening in the presence of a stream of material flow. The valve utilizes dynamically loaded, hard polymer seals which promote wear resistance and long term trouble free service. These gate seals provide positive material and air shut off to present a dust tight valve operation in pneumatic and vacuum conveying systems. The course of the gate between its open and closed positions is defined by a pair of dynamically loaded guide bars. The leading edge of the gate clears the material on these track-like guide bars during closure so as to present a self-cleaning action. Transverse gate seals that extend along opposed surfaces of the gate seal effectively and are easily lubricated and/or air purged. The lubricating seals extend gate life in severe service applications. These transverse seals are easily accessible for inspection or replacement without removal of the gate valve from service, so production down time is minimized. Seals along the top and bottom surfaces of the gate further seal the gate and clean the internal surfaces of particulate matter as the gate opens and closes.

It is therefore a general object of this invention to provide a gate valve which is constructed to effectively seal both particulate solids and differential air pressures between conduits upstream and downstream.

Another object of this invention is to provide a gate valve which keeps the interior seals free from particulates so as to enhance the sealing capabilities and minimize the seizing and binding of the gate during use.

A still further object of this invention is to provide a gate valve of the character described which utilizes dynamically loaded hard polymer seals so as to extend the seal life and promote trouble free service.

Another important object of this invention is to provide a gate valve which is constructed in a manner to keep the gate free of particulates.

A further object of this invention is to provide a gate valve of the character described which makes use of dynamically loaded guide bars along the side edges of the gate in order to enhance the reciprocative gate movement between open and closed positions. The guide bars are arranged to avoid the wedging of particulate matter along the sides of the gate, thus promoting extended service of the seals.

Another particular object of this invention is to provide a gate valve of the character described which precludes internal material buildup so as to eliminate gate seizing and binding.

A still further object of this invention is to provide a gate valve which is interchangeable with various releasably-connected actuators so as to preclude the need to remove the gate valve from use during service.

Another object of this invention is to provide a gate valve in which the external air seals are readily accessible for inspection or replacement while the valve remains in service.

An additional object of the invention is to provide a gate valve of the character described which is equipped with multiple sets of external air seals and with fluid ports leading to channels between the seals in each set so that each seal can be lubricated and/or purged by the application of air under pressure.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
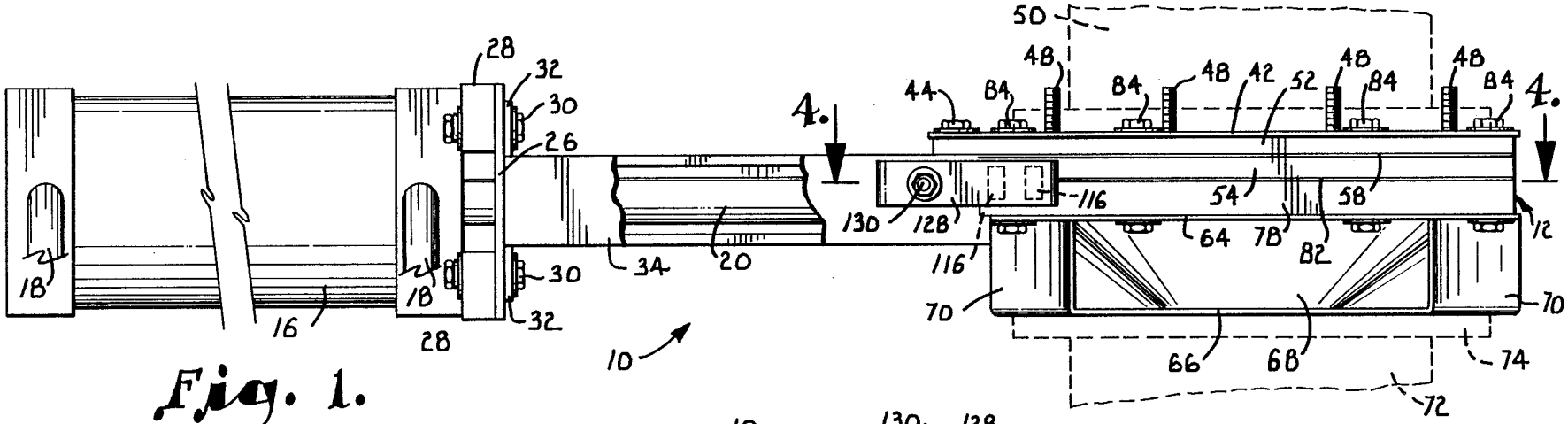
FIG. 1 is a side elevational view of a knife gate valve constructed according to a preferred embodiment of the present invention, with a portion broken away for illustrative purposes and the valve installed between incoming and outgoing conduits which are depicted in broken lines.
Figure 2:
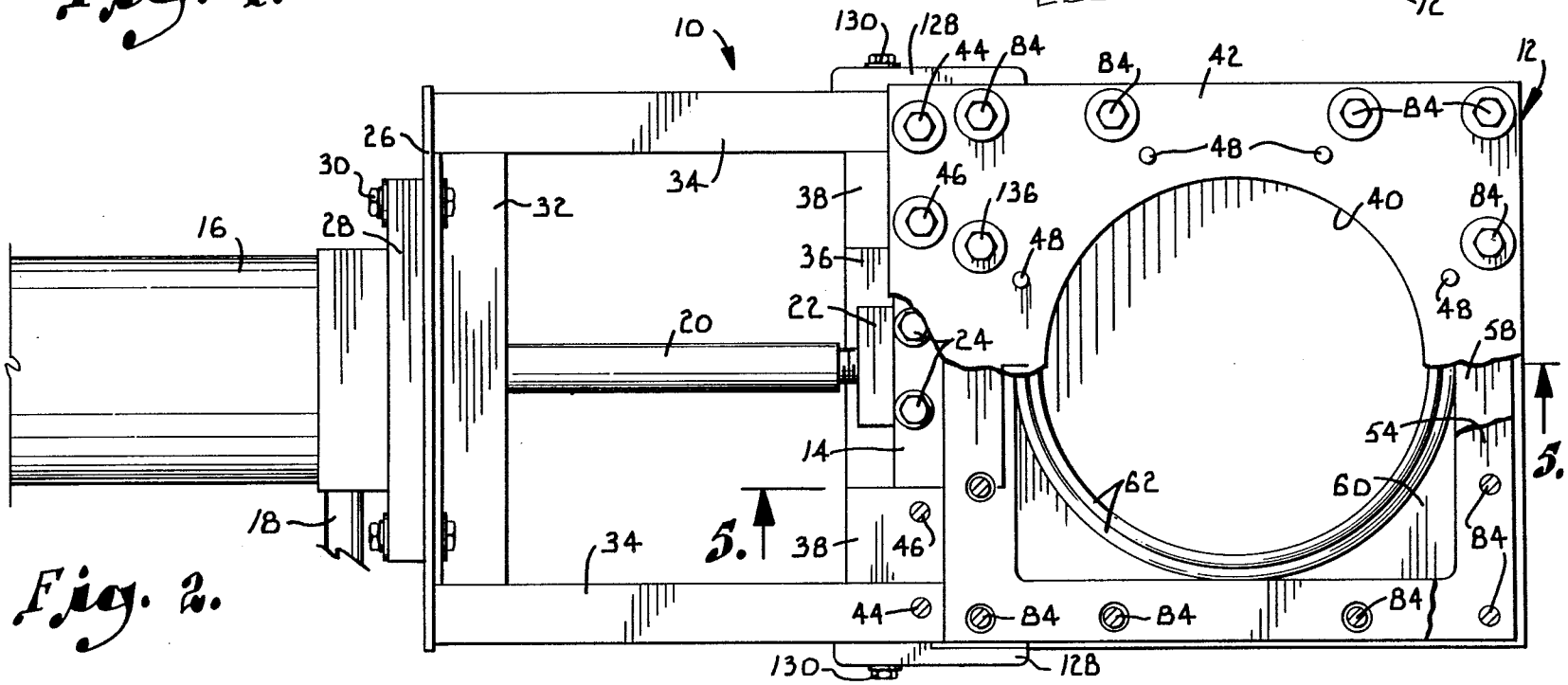
FIG. 2 is a top plan view of the gate valve shown in FIG. 1, with portions broken away for purposes of illustration.
Figure 3:
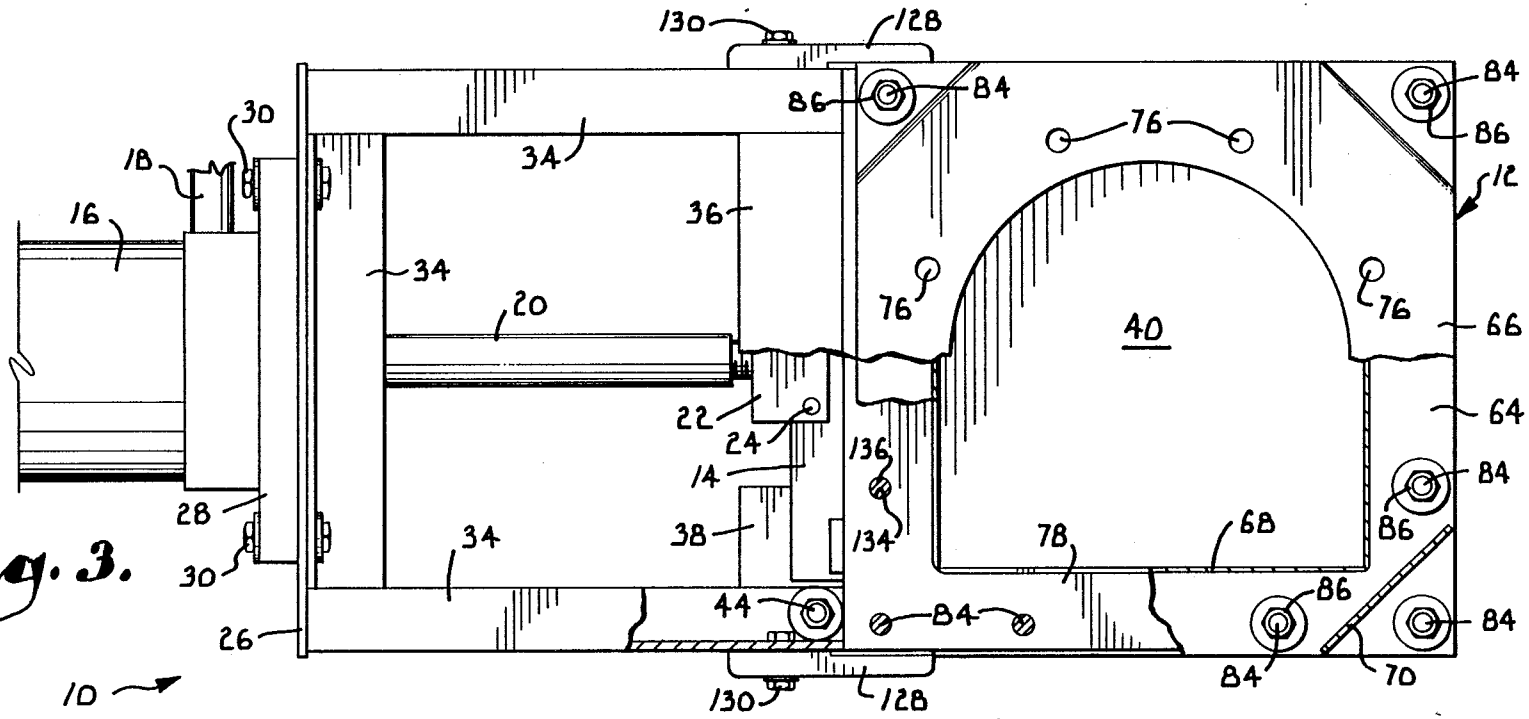
FIG. 3 is a bottom plan view of the gate valve, with portions broken away and portions shown in section for purposes of illustration.

Referring now to the drawings in more detail and initially to FIGS. 1-3 in particular, numeral 10 generally designates a knife gate valve constructed in accordance with a preferred embodiment of the present invention. The valve 10 has a valve body or housing which is generally identified by numeral 12 and which has a substantially square configuration. A flat, rectangular knife gate 14 is received in the valve housing 12 for reciprocating linear movement between open and closed positions of the valve.

Reciprocation of the gate 14 is effected by a conventional pneumatic cylinder 16 having pneumatic lines 18 supplying air to the cylinder. The cylinder 16 extends and retracts a piston rod 20 having a block 22 on its outer end. The block 22 is secured to the back or trailing edge portion of the gate 14 by a pair of bolts 24.

The actuating cylinder 16 is mounted on a rigid frame that includes a vertical mounting plate 26. Upper and lower mounting pads 28 are secured to cylinder 16 and are connected with one side of plate 26 by bolt/nut assemblies 30. The bolt/nut assemblies 30 also connect upper and lower angle members 32 to the other side of the plate 26. A pair of channels 34 extend from the opposite ends of the angle members 32 along the sides of the actuator frame. Extending between the lower flanges of the channels 34 is a flat plate 36. Smaller plates 38 are secured to the upper flanges of the channels 34 and generally overlie the lower plate 36.

The piston rod 20 is located midway between the two channels 34 and is parallel with them. It is contemplated that top and bottom cover plates (not shown) will be secured to extend between the upper and lower flanges of channels 34 in order to enclose the rod 20.

The valve housing 12 provides a flow aperture or opening 40 which extends from top to bottom through the valve housing to provide a flow passage for granular material to flow through the valve when the gate 14 is open. The top or inlet side of the valve housing 12 includes a square plate 42 which overhangs the channels 34 and the plates 38 of the actuator frame. The valve housing 12 is secured to the actuator frame by a pair of bolts 44 which secure the top plate 42 to the channels 34 and another pair of bolts 46 which secure plate 42 to the plates 38. A plurality of threaded studs 48 project upwardly from plate 42 and, as best shown in FIG. 1, may be used to secure a flanged inlet conduit 50 to the valve housing. The conduit 50 is aligned with the flow opening 40 in the valve housing.

Figure 5:
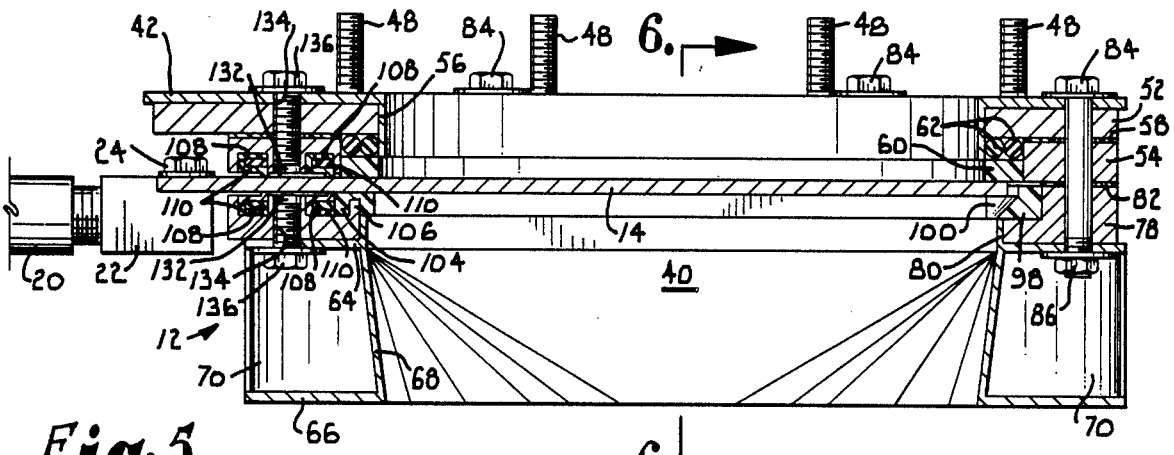
FIG. 5 is a fragmentary sectional view on an enlarged scale taken generally along line 5—5 of FIG. 2 in the direction of the arrows.
Figure 6:
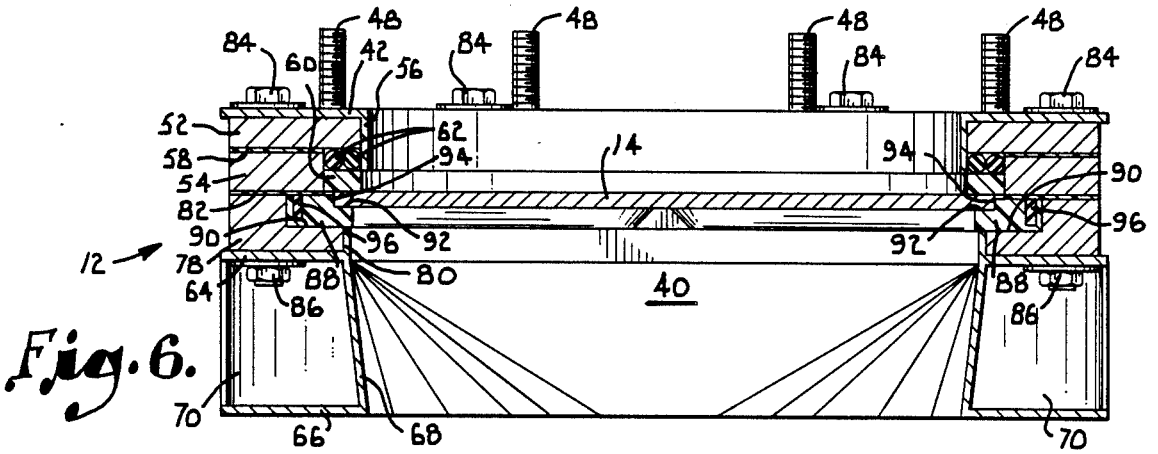
FIG. 6 is a fragmentary sectional view taken generally along line 6—6 of FIG. 5 in the direction of the arrows.
Figure 7:
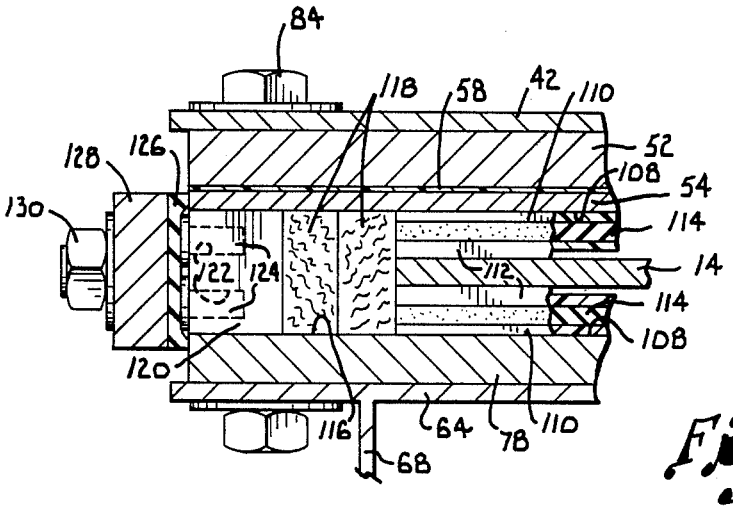
FIG. 7 is a fragmentary sectional view on an enlarged scale taken generally along line 7—7 of FIG. 4 in the direction of the arrows.

With additional reference to FIGS. 5-7, the upper portion of the valve housing 12 includes a pair of plates 52 and 54 which underlie the top plate 40. Plate 52 immediately underlies plate 40 and has a central round opening which closely receives a circular rim 56 projecting downwardly from the top plate 40. The flow opening 40 extends within the rim 56. Plate 54 immediately underlies plate 52 and is sealed thereto by a flat gasket 58. Plate 54 has a square opening through its center in which a square seal plate 60 closely fits. Immediately overlying the seal plate 60 are a pair of concentric o-rings 62 which extend around the outside of the rim 56 within the square opening in plate 54. The o-rings 62 are located beneath plate 58 and are squeezed between plate 58 and the underlying seal plate 60 to exert a compressive force urging plate 60 downwardly.

The seal plate 60 provides a seal against the top surface of the gate 14, and the seal plate has a central circular opening which forms part of the flow passage 40. The seal plate 60 is in sliding contact with the metal gate 14 as the gate moves between its open and closed positions. Accordingly, the seal plate 60 is formed from a material that is able to seal against the gate without being galled or otherwise unduly worn by sliding contact with the gate. An aluminum/bronze alloy or various hard, non-cold flowable plastic composites may be used to construct the seal plate 60. Preferably, plate 60 is constructed of a hard nylon which is compounded with a non-toxic lubricant. The o-rings 62 act to preload the pressure plate 60 to maintain the seal plate in good sealing contact with the underlying gate 14. The o-rings 62 are preferably constructed of a compression set and temperature resistant silicon rubber compound.

With continued reference to FIGS. 5 and 6 in particular, the lower portion of the valve housing 12 which is located beneath the gate 14 includes a base portion having upper and lower plates 64 and 66 and a wall 68 which extends between and connects the plates 64 and 66. Plate 64 is provided with a square opening which forms part of the flow opening 40, while the lower plate 66 is provided with a central circular opening located at the outlet end of the flow opening 40. The wall 68 is convergent from top to bottom and provides a transition between the square opening in plate 64 and the round opening in plate 66. As best shown in FIGS. 1 and 3, vertical plates 70 interconnect plates 64 and 66 and are oriented to angle across the four corners of the base portion of the housing. An outlet conduit 72 (see FIG. 1) having a flange 74 may be secured to the base plate 66. As shown in FIG. 3, the base plate 66 is provided with a plurality of openings 76 for receiving fasteners that secure the flange 74 to plate 66 with the outlet conduit 72 in alignment with flow opening 40.

Referring again to FIGS. 5 and 6 in particular, the lower portion of the valve housing includes another plate 78 which is mounted on top of plate 64 and which has a square central opening that closely receives a square rim 80 projecting upwardly from the inside edge of plate 64. A flat gasket 82 provides a seal between plate 78 and the immediately overlying plate 54.

Plates 52, 54 and 78 are stacked on top of one another and are sandwiched between plate 40 at the top and plate 64 at the bottom. Bolts 84 are extended through all of these plates and receive nuts 86 in order to secure the valve housing 12 in its assembled condition.

With particular reference to FIG. 6, a pair of guide bars 88 are seated on horizontal ledges 90 which are provided on plate 78 adjacent to the opposite sides of the flow passage 40. Each guide bar 88 presents an upwardly facing shoulder 92 and an inwardly facing wall surface 94 adjacent to the outer edge of the shoulder 92. The side edges of the gate 14 ride on top of the shoulders 92 and are in contact with the wall surfaces 94.

The guide bars 88 are in sliding contact with the gate 14 and seal against the side edge portions of the gate. Preferably, the guide bars 88 are constructed of the same material as the seal plate 60 in order to provide good wear resistance while effectively sealing against the gate at the same time. Outwardly from the wall surface 94, each guide bar 88 is provided with a longitudinal groove that closely receives an elongate compression element 96 that extends the entire length of the guide bar. The compression elements 96 are internal to the guide bars 88 and are under compression to continuously urge the wall surfaces 94 inwardly in order to maintain them in effective sealing contact with the opposite side edges of the gate 14. Preferably, the compression elements 96 are constructed of a compression set and temperature resistant silicon rubber compound.

Referring now to FIG. 5 in particular, a transverse bar 98 is seated on a ledge formed on plate 78 at the end of the valve body 12 remote from the pneumatic cylinder 16. The transverse bar 98 is preferably constructed of the same material as the guide bars 88, and it includes a central lip 100 on which the leading edge of the gate 14 seats when the gate is fully closed.

Figure 4:
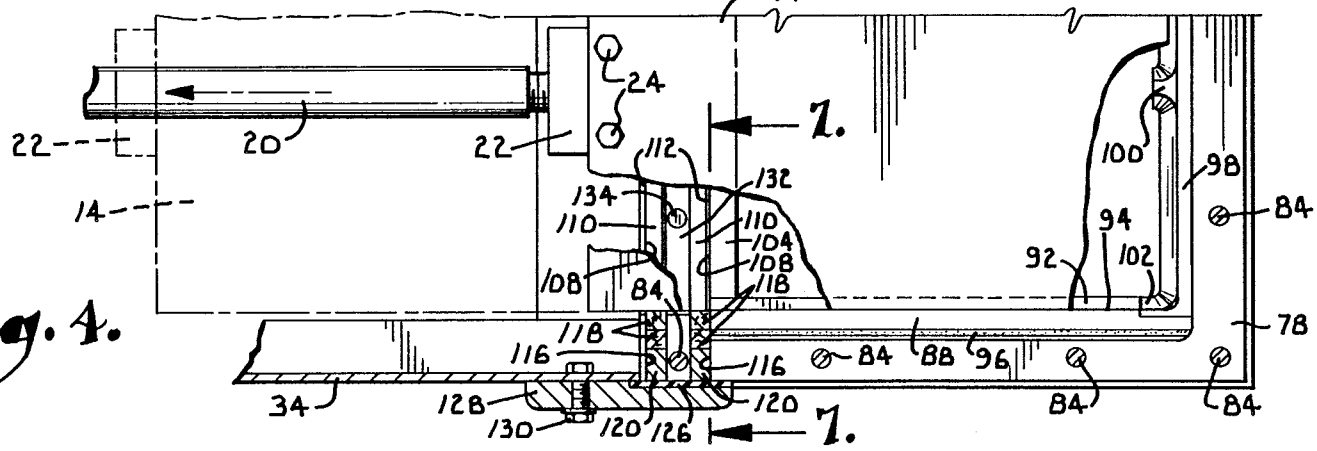
FIG. 4 is a fragmentary sectional view taken generally along line 4—4 of FIG. 1 in the direction of the arrows, with portions broken away for illustrative purposes and with the gate shown in its open position in broken lines.

Referring now to FIG. 4, the shoulder 92 of each bar terminates a short distance away from the transverse bar 98 to present a gap 102 between the end of the shoulder 92 and the bar 98. As will be explained more fully, the gaps 102 provide passages through which particulate material may drop into the flow passage 40 as the material is scraped from the shoulders 92 during closing movement of the gate 14.

Referring again to FIG. 5, a transverse wiping bar 104 extends between the guide bars 88 across the end of the valve housing 12 opposite the other transverse bar 98. Bar 104 is mounted on a ledge formed on plate 78 and is secured in place by a rib 106 which extends upwardly from the ledge and into bar 104. Bar 104 is in sliding contact with the underside of the gate 14 and is preferably constructed of hard nylon compounded with a non-toxic lubricant in order to effectively seal against the gate without becoming galled or otherwise worn unduly by sliding contact with the gate.

As best shown in FIGS. 5 and 7, each of the housing plates 54 and 78 is provided with a pair of parallel grooves 108 located adjacent to the gate 14 and extending transversely across the valve housing 12 at the end nearer to the pneumatic cylinder 16. The grooves 108 located above the gate are aligned above the corresponding grooves located below the gate. Each groove 108 receives an elongated seal element 110 which is preferably constructed of a hard nylon compounded with non-toxic lubricant. The seal elements 110 fit closely in the grooves 108, and each seal element 110 has a projecting lip 112 (FIG. 7) which is in sliding contact with the gate 14. Each seal element 110 is provided with a groove which closely receives an elongated compression element 114 that may be constructed of a compression set and temperature resistant silicon rubber compound. Each of the compression elements 114 is under compression, and the elements 114 thus act internally of the seal elements such that the lips 112 are urged against the gate 14.

All of the seal elements 110 are accessible so that they can be inspected and/or replaced while the valve 10 remains in service. Access is provided to the seal elements 110 from both sides of the valve housing 12, and the means by which the seal elements are accessible from the sides of the valve housing are illustrated in FIGS. 4 and 7 for one side. Plates 54 and 78 are provided with openings that cooperate to form a pair of passages 116 in the side of the valve housing 12, with each passage 116 leading to one pair of upper and lower grooves 108. A pair of seal blocks 118 fit closely in each passage 116. The two seal blocks 118 are positioned one against the other, and the inner block 118 acts against the ends of the seal elements 110 and also against the adjacent edge of the gate 14. Preferably, the seal blocks 118 are faced with a cold flowable and temperature resistant plastic material backed by a high density elastic material that is preloaded in a manner to exert compressive forces which maintain the inner block 118 against the ends of the seal elements 110 and the gate edge. A TFE (tetrafluorethylene) composite material has been found suitable for seal blocks 118.

A metal block 120 is closely received in each passage 116 outwardly of the seal blocks 118. Each block 120 is provided with a pair of threaded passages 122 (see FIG. 7) into which screws 124 are threaded. A single gasket 126 covers both of the passages 116 on the side of the valve housing. The gasket 126 seals the passages 116 and the heads of the screws 124 bear against the gasket. The gasket 126 is received within a recess in a rigid metal cover 128 which is secured to the web of the adjacent channel 134 by a bolt/nut assembly 130.

As best shown in FIGS. 4 and 5, plates 54 and 78 present shallow channels 132 that extend between each pair of grooves 108. Fluid ports 134 extend from the exterior of the valve housing 12 to the channels 132 in order to permit the application of fluid to the channels 132 and grooves 108 from the exterior of the valve. The ports 134 are normally closed by threaded bolts 136 or another type of removable plug.

In operation of the valve, the gate 14 is reciprocated between its open and closed positions by the pneumatic cylinder 16. When the cylinder 16 extends its rod 20, the gate 14 is moved toward the closed position in which it blocks the flow opening 40 and prevents the flow of material through the valve. When cylinder 16 retracts rod 20, gate 14 is withdrawn from the flow opening 40, and the flow opening is thus opened so that the dry bulk materials that are handled by the valve can flow through the opening 40 from the inlet conduit 50 to the outlet conduit 72. Normally, the particulate materials that are handled by the valve are conveyed between the conduits by a pneumatic conveying system that applies air under pressure to the inlet side of the system, or by a vacuum conveying system which applies vacuum to the outlet end of the system. In either event, there is a pressure differential across the valve 10 and the valve must be able to provide a fluid tight seal in order to prevent pressure loss.

When the gate 14 is moved from the closed position to the open position under a head of particulate material, the material that tends to adhere to the top surface of the gate is scraped off of the gate by the pressure loaded seal plate 56. Likewise, any material that adheres to the underside of the gate 14 is scraped clear of the gate by the transverse wiping bar 104.

Conversely, when the gate is moved from the open position toward the closed position, any material that adheres to the bottom of the seal plate 60 is scraped off of the seal plate by the gate. Any material standing on either of the shoulders 92 is scraped by the leading portion of the gate 14 along the shoulder and eventually off of the shoulder through the gap 102 formed near the end of the shoulder. This material passes through the gap 102 and back into the flow passage of the conveying system. It is also noted that the pressure loading of the guide bars 88 keeps the wall surfaces 94 firmly against the side edges of the gate, and this keeps particulate material from becoming wedged between the guide bar and the gate edges. It is further noted that the guide bars 88 and particularly the shoulders 92 are recessed or displaced outwardly from the inside edge of the seal plate 60, as best shown in FIG. 6. Thus, the amount of particulate material that is able to reach the shoulders 92 is minimized and the amount of material that the gate needs to clear from the shoulders 92 is relatively small. In addition, the recessed location of the shoulders 92 minimizes the abrasive action of the particulate matter against the guide bars 88.

In this manner, the construction of the valve 10 provides for positive clearing of particulate solids from all areas of the interior sealing members, and this prevents lodged particles from causing binding or other difficulty in the movement of the gate. Additionally, the sealing surfaces remain free of lodged particles and they are thus able to seal effectively against the gate.

The transverse seal elements 110 which provide fluid tight seals for the valve 10 may be cleaned, inspected and/or replaced if necessary while the gate valve remains in service. In order to obtain access to the seal elements 110, it is only necessary to loosen the bolt/nut assembly 130, swing the cover 128 out of the way and remove block 120 and the seal blocks 118. The seal elements 110 are then accessible and may be removed and cleaned or replaced if necessary.

The seal blocks 118 are compressed against the ends of the seal elements 110 and the side edges of the gate by the block 120. The pressure with which the seal blocks 118 act against the seal elements 110 and the gate may be adjusted by threading the screws 124 into or out of the threaded passages 122 in block 120. When the screws are adjusted outwardly, more pressure is applied to the seal blocks 118, and the converse is true when the screws are threaded into the passages 122.

The seal elements 110 can be lubricated while the gate valve remains in service. Lubrication is accomplished by removing the screws 136 and applying lubricating fluid to the ports 134 and through the channels 132 to grooves 108. It is noted that each channel 132 extends along substantially the entire length of the grooves 108 so that the lubricant is distributed along the lengths of the seals 110. Applying the lubricant between the seals minimizes contact of the lubricant with the materials handled by the valve. Air purging of the seals 110 can be accomplished by applying air under pressure to the ports 134.

In addition to the pneumatic cylinder 16, the gate valve may be actuated by a hydraulic actuator, a manual actuator, or an electrical actuator. The valve housing 112 can be completely disconnected from the actuator and its frame by removing the two bolts 24, the two bolts 44 and the two bolts 46. As a result, bench repairs or interchange of actuating devices can be carried out, even while the gate valve remains in service, and this can lead to significant reductions in maintenance costs.

Preferably, the metal components of the valve 10 are constructed of aluminum, stainless steel or some combination of aluminum and stainless steel in order to achieve corrosion resistance, wear resistance, light weight and economical fabrication. All parts that may contact the material that is being handled are either stainless steel or food grade polymers that will not contaminate food products handled by the valve.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. A gate valve for controlling the flow of solid particulate material, said gate valve comprising:

a valve housing presenting a flow opening through which the material may pass;

a gate having opposing surfaces and opposite side edges, said gate being mounted to the housing for movement between an open position wherein said flow opening is open and a closed position wherein the gate closes said flow opening;

means for effecting movement of the gate between the open and closed positions;

a pair of guide bars mounted in said housing substantially the entire length of said housing for guiding said gate between the open and closed positions, each bar presenting a wall which bears against the corresponding side edge of the gate and a shoulder along which one of said gate surfaces rides between the open and closed positions;

pressure loaded sealing means in said housing sealing against the other of said gate surfaces around the flow opening; and means acting along substantially the entire length of said guide bars for urging said guide bars toward the corresponding side edges of the gate to maintain said walls against the side edges such that any material on said shoulders is scraped along the shoulders by the gate during closing of the latter.

2. The valve of claim 1, wherein:

each guide bar has opposite first and second ends with the first end located such that the gate moves toward it as the gate approaches the closed position; and each guide bar has a gap in the shoulder thereof located adjacent the first end of the bar to provide a passage into the flow opening for material scraped along the guide bar shoulder during closing of the gate.

3. The valve of claim 1, including:

opposite first and second ends of each guide bar, the first end of each bar being located such that the gate moves toward it as the gate approaches the closed position; and a transverse wiper bar in the housing extending between the second ends of said guide bars in an orientation transverse to the direction of gate movement, said wiper bar acting to wipe material from said one gate surface as the gate moves from the closed position to the open position.

4. The valve of claim 1, wherein each bar is offset laterally relative to said sealing means in a direction away from said flow opening.

5. The valve of claim 1, wherein said urging means comprises a compression element extending in each guide bar internally thereof lengthwise of the bar, each compression element being compressed to apply a preloaded force to the corresponding guide bar urging the wall thereof toward the corresponding side edge of the gate.

6. The valve of claim 1, wherein said pressure loaded sealing means comprises:

a pressure plate having a sealing surface adjacent said other gate surface and an opening aligned with the flow opening; and an annular seal ring extending around the flow opening and bearing against said pressure plate, said annular seal ring being under compression in a direction parallel to the direction of material flow through the flow opening to apply a preloaded force to the pressure plate urging the same toward the gate.

7. The valve of claim 1, including:

opposite first and second ends of each guide bar, the first end of each bar being located such that the gate moves toward it as the gate approaches the closed position; and transverse seal means for effecting transverse seals against said opposing gate surfaces adjacent said second ends of the guide bars.

8. The valve of claim 7, including:

means for mounting said transverse seal means in the valve housing in a manner permitting removal of the transverse seal means from the housing; and means for providing access to said transverse seal means from the exterior of the valve housing.

9. The valve of claim 7, wherein said transverse seal means comprises:

a first elongate seal element mounted in the housing adjacent said one gate surface and extending transversely to the direction of gate movement; and a second elongate seal element mounted in the housing adjacent said other gate surface and extending transversely to the direction of gate movement, said first and second elongate seal elements sealing against the gate in opposition to one another.

10. The valve of claim 9, including a projecting lip on each elongate seal element for contacting the gate.

11. The valve of claim 1, including:

a first pair of spaced apart seal elements mounted in the housing and extending transversely to the direction of gate movement, the seal elements in said first pair effecting transverse seals against said one surface of the gate; and a second pair of spaced apart seal elements mounted in the housing and extending transversely to the direction of gate movement, the seal elements in said first pair effecting transverse seals against said other surface of the gate.

12. The valve of claim 11, including:

a channel in the housing between the seal elements in each pair; and fluid port means for directing fluid applied externally of the valve housing to each of said channels.

13. The valve of claim 11, including:

a passage in said valve housing extending from the exterior thereof and providing access to one seal element in each pair thereof;

a seal block in said passage bearing against one end of said one seal element in each pair thereof and against one side edge of the gate; and means for maintaining said seal block against said one seal element in each pair and against said one side edge of the gate.

14. The valve of claim 13, wherein:

said maintaining means comprises a retainer plate releasably secured to the housing and covering said passage; and said seal block is removable from said passage to provide access therethrough to said one seal element in each pair when said retainer plate is released.

15. In a gate valve having a valve housing presenting a flow opening and a gate mounted for reciprocating linear movement on the housing between open and closed positions to respectively open and close the flow opening, the improvement comprising:

an elongate seal element for sealing against the gate;

means for mounting said seal element in said housing in a manner permitting the seal element to be removed from the housing and at a location at which the seal element extends transversely to the direction of gate movement to provide a transverse seal against the gate; and means on the housing for providing access to said seal element from the exterior of the valve housing to permit removal of the seal element from the housing while the gate valve is in service.

16. The improvement of claim 15, wherein said mounting means comprises a transverse groove in the housing, said seal element fitting closely in said groove and being removable therefrom.

17. The improvement of claim 16, wherein:

said groove has opposite ends; and said access providing means comprises a passage extending to one end of said groove from the exterior of the valve body and removable means for closing said passage.

18. The improvement of claim 17, wherein said removable means comprises:

a seal block mounted in said passage adjacent said one end of the groove for engaging said seal element and gate; and a cover for the passage mounted on the valve body in a manner to permit the passage to be selectively opened and closed.

19. The improvement of claim 18, including means interposed between said seal block and cover for pressing the seal block against said seal element and gate when the cover is closed.

20. The improvement of claim 19, including means for varying the force with which said seal block is pressed against said seal element and gate.

21. In a gate valve having a valve housing presenting a flow opening and a gate mounted for reciprocating linear movement on the housing between open and closed positions to respectively open and close the flow opening, the improvement comprising:

a pair of elongate seal elements for sealing against a surface of the gate, said seal elements being mounted in the housing at spaced apart locations in extension transversely to the direction of gate movement to provide transverse seals against said gate surface as the gate reciprocates between the open and closed positions;

a channel in said valve housing communicating with both seal elements;

a fluid port extending from the exterior of the valve housing to said channel to permit application of fluid to the channel; and removable means for plugging said fluid port.

* * * * *